US010309193B2

(12) United States Patent
Gordon et al.

(10) Patent No.: US 10,309,193 B2
(45) Date of Patent: Jun. 4, 2019

(54) VALVE APPARATUS HAVING DISSOLVABLE OR FRANGIBLE FLAPPER AND METHOD OF USING SAME

(71) Applicant: Cajun Plugs, LLC

(72) Inventors: Danny L. Gordon, Parks, LA (US); Kenneth Perry, Youngsville, LA (US)

(73) Assignee: Premium Tools LLC, Houston, TX (US)

( * ) Notice: Subject to any disclaimer, the term of this patent is extended or adjusted under 35 U.S.C. 154(b) by 108 days.

(21) Appl. No.: 15/424,109

(22) Filed: Feb. 3, 2017

(65) Prior Publication Data

US 2017/0218722 A1 Aug. 3, 2017

Related U.S. Application Data

(60) Provisional application No. 62/290,512, filed on Feb. 3, 2016.

(51) Int. Cl.

| | |
|---|---|
| ***E21B 33/134*** | (2006.01) |
| ***E21B 34/06*** | (2006.01) |
| *E21B 34/00* | (2006.01) |

(52) U.S. Cl.

CPC ..... *E21B 34/063* (2013.01); *E21B 33/134* (2013.01); *E21B 2034/005* (2013.01)

(58) Field of Classification Search

CPC .... E21B 33/128; E21B 33/129; E21B 33/134; E21B 34/063; E21B 2034/005

See application file for complete search history.

(56) References Cited

U.S. PATENT DOCUMENTS

| | | | | |
|---|---|---|---|---|
| 8,430,173 | B2 * | 4/2013 | Todd | E21B 33/1204 166/317 |
| 8,434,559 | B2 * | 5/2013 | Todd | E21B 33/1204 166/317 |
| 2011/0088891 | A1 * | 4/2011 | Stout | E21B 33/1204 166/120 |
| 2016/0069155 | A1 * | 3/2016 | Todd | E21B 34/063 166/292 |
| 2016/0186514 | A1 * | 6/2016 | King | E21B 33/134 166/250.01 |

* cited by examiner

*Primary Examiner* — Matthew R Buck
(74) *Attorney, Agent, or Firm* — Ted M. Anthony

(57) ABSTRACT

A bridge plug for use in a wellbore having an anchoring system to grip the inner surface of the surrounding wellbore, as well as a sealing system or packing element to seal against the inner surface. A hinged flapper permits flow of fluid in one axial direction through a central through bore, but can selectively contact against a seat to create a fluid pressure seal and prevent fluid flow through said central through bore in an opposite axial direction. The flapper can be manufactured of frangible material and/or dissolvable material, permitting selective removal of the flapper when desired.

20 Claims, 13 Drawing Sheets

VALVE APPARATUS HAVING DISSOLVABLE OR FRANGIBLE FLAPPER AND METHOD OF USING SAME

BACKGROUND OF THE PRESENT INVENTION

Field of the Invention

The present invention pertains to a valve assembly that can be used in wellbore operations (such as, for example, in oil, gas, water or disposal wells). More particularly, the present invention pertains to a downhole valve assembly that can be used in wellbore operations, such as well intervention and/or hydraulic fracturing operations. More particularly still, the present invention pertains to a downhole flapper valve assembly having a dissolvable or frangible flapper.

Brief Description of the Prior Art

Frequently, it is desirable to install at least one bridge plug, or other anchoring and sealing device, within a wellbore. Such assemblies can be installed for various reasons: to isolate one portion of a wellbore from another, to prevent fluid flow from one portion of a wellbore to another, and/or provide a fluid pressure sealing barrier at a desired location within said wellbore. Such downhole bridge plugs or other anchoring/sealing devices are frequently installed within the central bore of a casing or tubing string, and both grip/anchor and provide a fluid pressure seal against the inner wall of such pipe. In certain applications, such plugs can also be installed within a section of drilled "open hole" (that is, a section of a wellbore that is not cased with pipe).

Conventional bridge plugs typically comprise an anchoring system designed to grip the inner surface of a surrounding wellbore, as well as a sealing system or packing element to form a fluid pressure seal against said inner surface. Some predetermined amount of force is generally required to energize/expand said packing element and actuate said anchoring system. In certain plug assemblies, such force or load can be supplied by pipe weight situated above the bridge plug, or by tensile loading applied from a wellbore surface; such plugs generally must be continually attached to a pipe string during the setting process in order to receive the force required to actuate said anchor system and energize/expand said sealing mechanism. In other cases, such plug assemblies can be conveyed into a wellbore on spooled wireline to a desired location, and actuated using a specially designed plug setting tool.

Conventional bridge plugs are frequently used in connection with hydraulic fracturing (commonly referred to as "fracking") operations, which generally entails pumping fluid into a wellbore at elevated pressures in order to fracture subterranean rock formations surrounding said wellbore. In many well fracturing operations, a bridge plug or "frac plug" is conveyed to a desired location within a wellbore. Once positioned at a desired location within a wellbore, the frac plug is actuated to secure or anchor said plug in position and prevent axial movement within said wellbore. Thereafter, a setting tool or other device used to set said plug in place can then be removed, leaving the plug securely anchored within the well bore.

Although designs can vary, many frac plugs have a central axial through bore as well as sealing seat on one end. A ball, dart or other object is typically launched or released into the wellbore from the surface or other point above said plug; eventually, said ball/dart/object will reach the plug and land on said seat. Once said ball/dart/object is securely received on said seat, said central through bore is blocked and fluid is prevented from flowing around said ball through said central through bore. With the central through bore of said plug blocked, hydraulic fracturing can be undertaken in up-hole section(s) of the well bore—that is, the portion of the well between the surface and said plug. Additionally, during downhole well intervention operations (that is, operations other than hydraulic fracturing), plugs and valves are periodically used inside a well bore to control, stop or regulate certain well performance variables such as flowrate and pressure.

Conventional bridge plugs typically suffer from a number of significant limitations. Many conventional mechanical bridge plugs are "permanent", in the sense that they generally cannot be opened or removed from a wellbore after being set without performing complicated and/or expensive downhole milling operations. Although not as "permanent" in design, ball and seat valves can nonetheless be problematic, particularly during cementing and stimulation operations. Cement and stimulation proppant material (such as, for example, "frac sand" used in hydraulic fracturing operations) can negatively affect the sealing function and operation of said valves.

Thus, there is a need for an effective and versatile down-hole bridge plug that can be set at a desired location within a wellbore. The bridge plug should permit isolation of desired portion(s) of a wellbore, while permitting removal and/or opening of said plug when desired.

SUMMARY OF THE PRESENT INVENTION

In a preferred embodiment, present invention comprises a valve assembly. Uses for said valve assembly can include, but are not limited to, a frac plug, fluid flow valve, check valve or well intervention device. The plug of the present invention can be used in bored holes, flow lines, sewer lines, open or closed well bores, agricultural applications, and medical procedures.

In a preferred embodiment, the present invention comprises a selectively closable flapper and a seat against which said flapper, when in a closed configuration, can form a fluid pressure seal. In addition, the present invention further comprises means (such as gripping slip members) to securely grip against a surrounding surface, and create a fluid pressure seal between said valve assembly and said inner surface of a surrounding wellbore or other structure. The sealing member(s) may be elastomeric or any other material that can create a seal between the invention and the inner walls of a surrounding wellbore or hole.

Actuation of said slip member(s) and seal(s) is typically accomplished using a conventional setting tool employing hydraulics, explosives, electronics, fluid pressure and/or the application of mechanical force. In a preferred embodiment, the present invention can also comprise at least one friction reducing element disposed on its outer surface to assist in running in a wellbore (including, without limitation, restrictions therein). Such friction reducing elements can be rolling devices such as ball transfer units or stationary sliding pads beneficially disposed on the exterior of the device.

The present invention can also be used as a check valve by setting a flapper to spring closed if fluid flow is in the opposite direction than desired. When acting as a check valve, the springs or other actuation methods on the present invention will make the device return to original (typically open) state once fluid pressure or flow has dissipated sufficiently to meet a predetermined level. The present invention can be used inside a well bore as a fluid flow control valve by controlling the flapper motion with a spring or other actuator. Depending on system needs, an actuator on the flapper can be sized to open and close in response to particular predetermined flow rates.

The present process that is used in the oilfield when setting a frac plug downhole is to deliver the plug to the desired position in the well, set the plug's slip and seals and then pull the setting tool and entire tool string out of the hole. The well head is opened and a ball is inserted into the well. The well head is closed again and the ball is pumped down into the well until it arrives at the seat. This process requires a large amount of fluid to pump the ball down but also a large amount of rig time which is extremely costly. The present invention does not require any additional pumping of fluid to seat a ball, thereby reducing the expense of fluid and this also reduces expensive rig time compared to such conventional methods.

Another benefit of the present invention is to reduce the amount of water pumped into downhole formations, which can adversely affect productivity of certain reservoirs. The present invention also allows a user, if desired, to perform other operations such as perforating an interval without the need to fully retrieve a toolstring or pipe completely out the well. The present invention facilitates increased efficiency of time, resources and money spent to perform current tasks common to industries such as the oilfield in particular in well hydraulic fracturing operations.

The present invention can also be used as a check valve by setting a flapper to spring closed if fluid flow is in an opposite direction than desired. When acting as a check valve, springs or other actuation methods on the present invention will make the device return to original (typically open) state once fluid pressure or flow has dissipated sufficiently to meet a predetermined level. The present invention can be used inside a well bore as a fluid flow control valve by controlling the flapper motion with a spring or other actuator. Depending on system needs, an actuator on the flapper can be sized to open and close in response to particular predetermined flow rates.

After a fracturing procedure is completed, the valve assembly becomes an obstruction that does not allow a well to flow past said valve assembly. However, fluid or pressure differential from below the invention can open the flapper, therefore allowing fluid or pressure movement. In one embodiment, the flapper of the current invention includes a spring that biases said flapper after pumping from the surface stops to allow for the well to begin flowing. With this embodiment, a standard oilfield fishing tool can be used to stab back into the body opening to retrieve the device from the well without milling or drilling. In another embodiment, the flapper of the said invention can be in a normally opened or closed position. Applied or natural fluid pressure, or pressure differential, can open the flapper from the normally closed position or close the flapper from a normally opened position.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
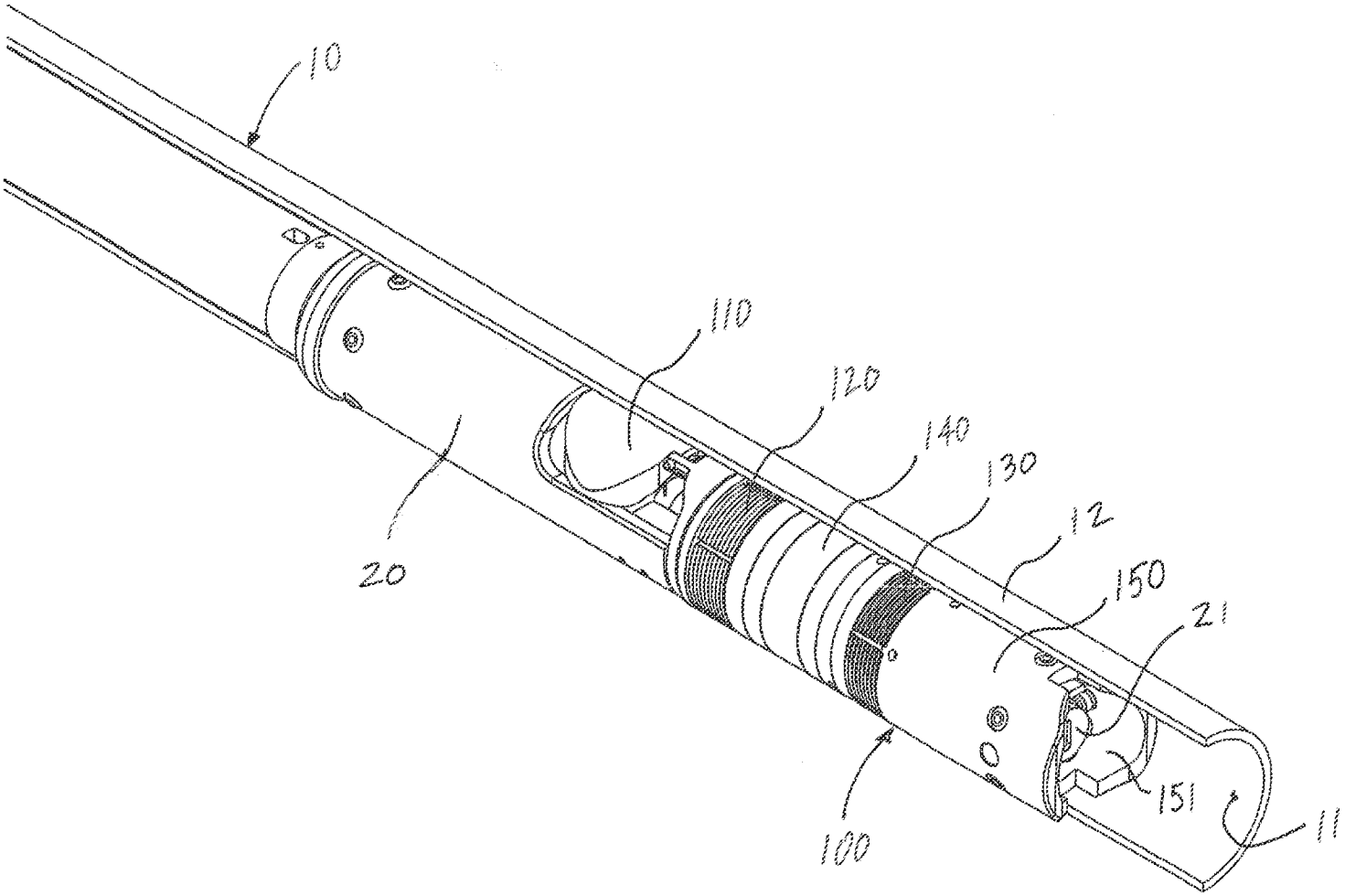
FIG. 1 depicts an overhead perspective view of the downhole valve assembly of the present invention operationally attached to a conventional setting tool and disposed within a wellbore.

Referring to the drawings, FIG. 1 depicts an overhead perspective view of a downhole valve assembly 100 of the present invention operationally attached to a conventional setting tool 20 and disposed within casing string 10. As depicted in FIG. 1, casing string 10 has outer surface 12 and inner surface 11; said casing 10 can be installed and secured within a drilled bore hole in a manner well understood by those having skill in the art.

Downhole valve assembly 100 of the present invention can be installed to selectively isolate one portion of a wellbore from another, to prevent fluid flow from one portion of a wellbore to another and/or to provide a fluid pressure sealing barrier at a desired location within a wellbore. Valve assembly 100 of the present invention can be beneficially set within the internal bore of a string of casing (such as casing string 10 depicted in FIG. 1), production tubing or other tubular member. In certain applications or downhole environments, valve assembly 100 of the present invention can also be installed within an "open hole" or uncased section of a wellbore.

Valve assembly 100 of the present invention generally comprises a fluid pressure sealing flapper assembly having flapper 110, a mating flapper seat 111, upper gripping slip members 120, lower gripping slip members 130, sealing member 140 and body section 150. Although other relative positioning of said components can be used without departing from the scope of the present invention, said upper gripping slip members 120 and lower gripping slip members 130 are typically disposed on either side of said seal member 140.

In operation, valve assembly 100 of the present invention can be attached to a setting tool (such as setting tool 20) and conveyed into a well to a desired depth via continuous wire (such as, for example, electric line, slick line or braided line), continuous or coiled tubing, or jointed pipe. Once said valve assembly 100 is positioned at a desired location within a wellbore—that is, at the depth at which setting of valve assembly 100 is desired—said setting tool 20 can be actuated. Such actuation of setting tool 20 causes said upper gripping slip members 120 and lower gripping slip members 130 to expand radially outward to engage against a surrounding surface (such as inner surface 11 of casing string 10), and anchor said valve assembly 100 in place against axial movement within casing string 10. Such actuation of setting tool 20 also causes seal member 140 of said valve assembly 10 to expand radially outward until it contacts and forms a fluid pressure seal against a surrounding surface (such as inner surface 11 of casing string 10).

In a preferred embodiment, setting tool 20 can comprise a conventional wireline packer setting tool such as, for example, a Baker E4 Model 10 Setting Tool, which is well known to those having skill in the art. Notwithstanding the foregoing, it is to be observed that any number of other conventional setting tools can be used without departing from the scope of the present invention. As depicted in FIG. 1, a central mandrel 21 of setting 20 is visible through the open lower bore 151 of body section 150 of valve assembly 100.

Figure 2:
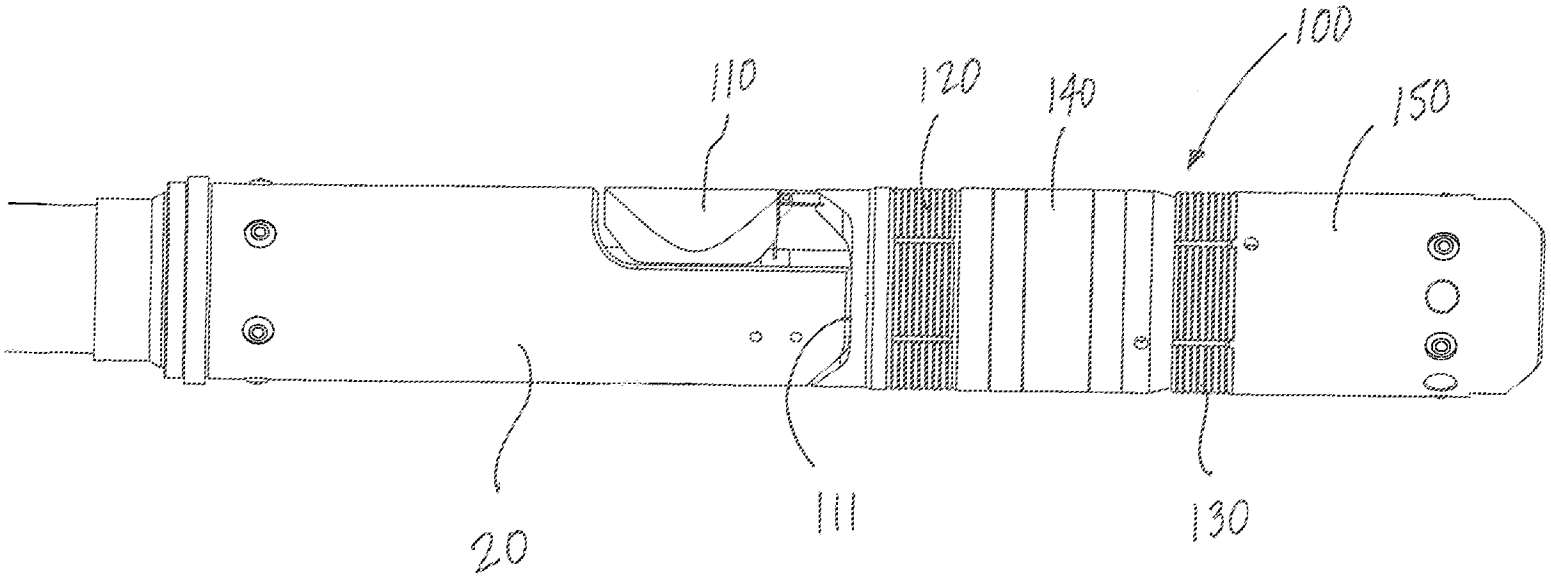
FIG. 2 depicts a side view of a downhole valve assembly of the present invention operationally attached to a conventional setting tool.

FIG. 2 depicts a side view of a downhole valve assembly 100 of the present invention operationally attached to a conventional setting tool 20. Valve assembly 100 of the present invention generally comprises a fluid pressure sealing flapper assembly having flapper 110 and flapper seat 111, upper gripping slip members 120, lower gripping slip members 130, seal member 140 and body section 150. In the embodiment of valve assembly 100 depicted in FIG. 2, said seal member 140 is disposed between upper gripping slip members 120 and lower gripping slip members 130.

Figure 3:
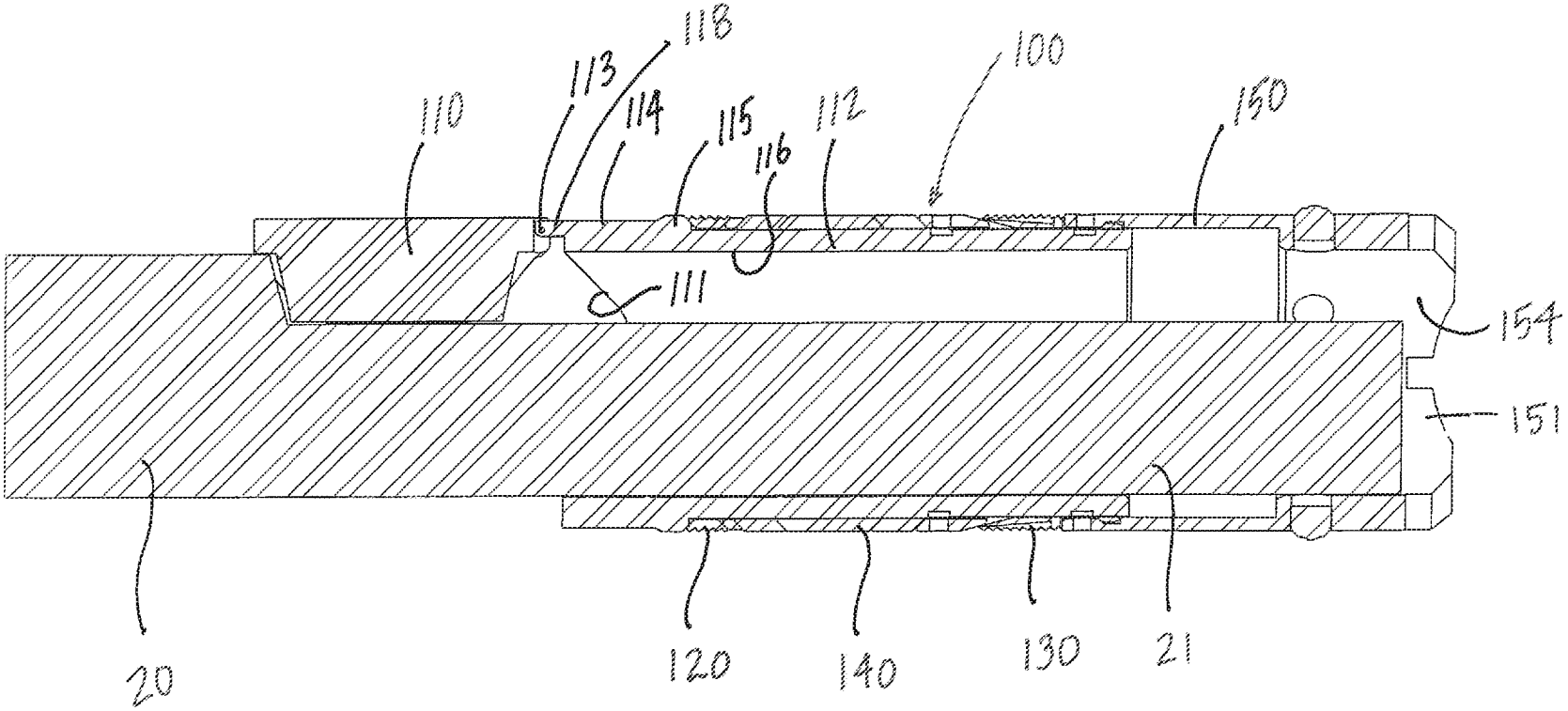
FIG. 3 depicts a side sectional view of a downhole valve assembly of the present invention operationally attached to a conventional setting tool.

FIG. 3 depicts a side sectional view of a downhole valve assembly 100 of the present invention operationally attached to a conventional setting tool 20. Valve assembly 100 of the present invention generally comprises a fluid pressure sealing flapper assembly having flapper 110 and flapper seat 111. Flapper 110 is hingedly attached to flapper seat body 112 with hinge pin 113 extending through hinge posts 118. Flapper seat body member 112 has outer surface 114 defining outer shoulder member 115 that extends radially outward therefrom, as well as a central through bore defining an inner surface 116.

Still referring to FIG. 3, upper gripping slip members 120, lower gripping slip members 130 and seal member 140 are disposed on outer surface 114 of flapper seat body member 112. Body section 150, having a central through bore 151 defining inner surface 154, is attached to flapper seat body member 112. In the configuration shown in FIG. 3, central mandrel 21 of setting tool 20 extends through aligned central bores of flapper seat body member 112 and body section 150. Said central mandrel 21 further holds flapper 110 in an open position; in other words, said central mandrel 21 prevents flapper 110 from hingedly closing and being received on flapper seat 111.

In operation, setting tool 20 can be actuated, causing upper gripping slip members 120 and lower gripping slip members 130 to expand radially outward to engage against a surrounding surface (such as inner surface 11 of casing string 10 depicted in FIG. 1). Such actuation of setting tool 20 also causes seal member 140 of said valve assembly 100 to expand radially outward until it contacts and forms a fluid pressure seal against a surrounding surface (such as inner surface 11 of casing string 10 depicted in FIG. 1).

Following such actuation and setting of valve assembly 100, setting tool 20 can be released from valve assembly 100 (such as by shearing of pins, for example) and pulled away from said valve assembly 100. As central mandrel 21 of setting tool 20 is extracted from the central bore of flapper seat body member 112, flapper 110 is no longer blocked and is allowed to pivot about hinge pin 113. Said flapper 110 can close until it contacts in mating relationship with flapper seat 111.

Figure 4:
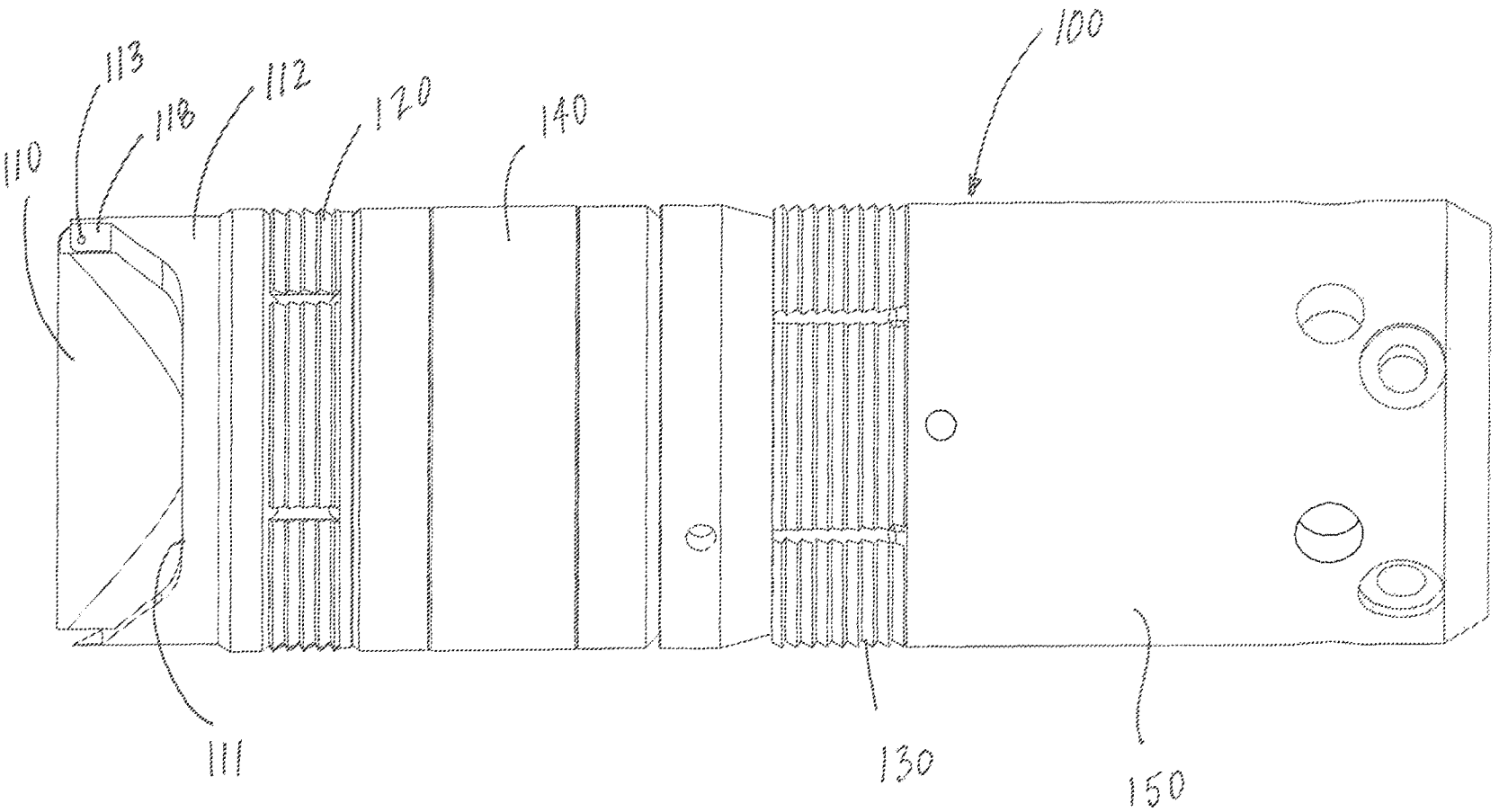
FIG. 4 depicts a side view of a downhole valve assembly of the present invention with a flapper valve in a closed position.
Figure 5:
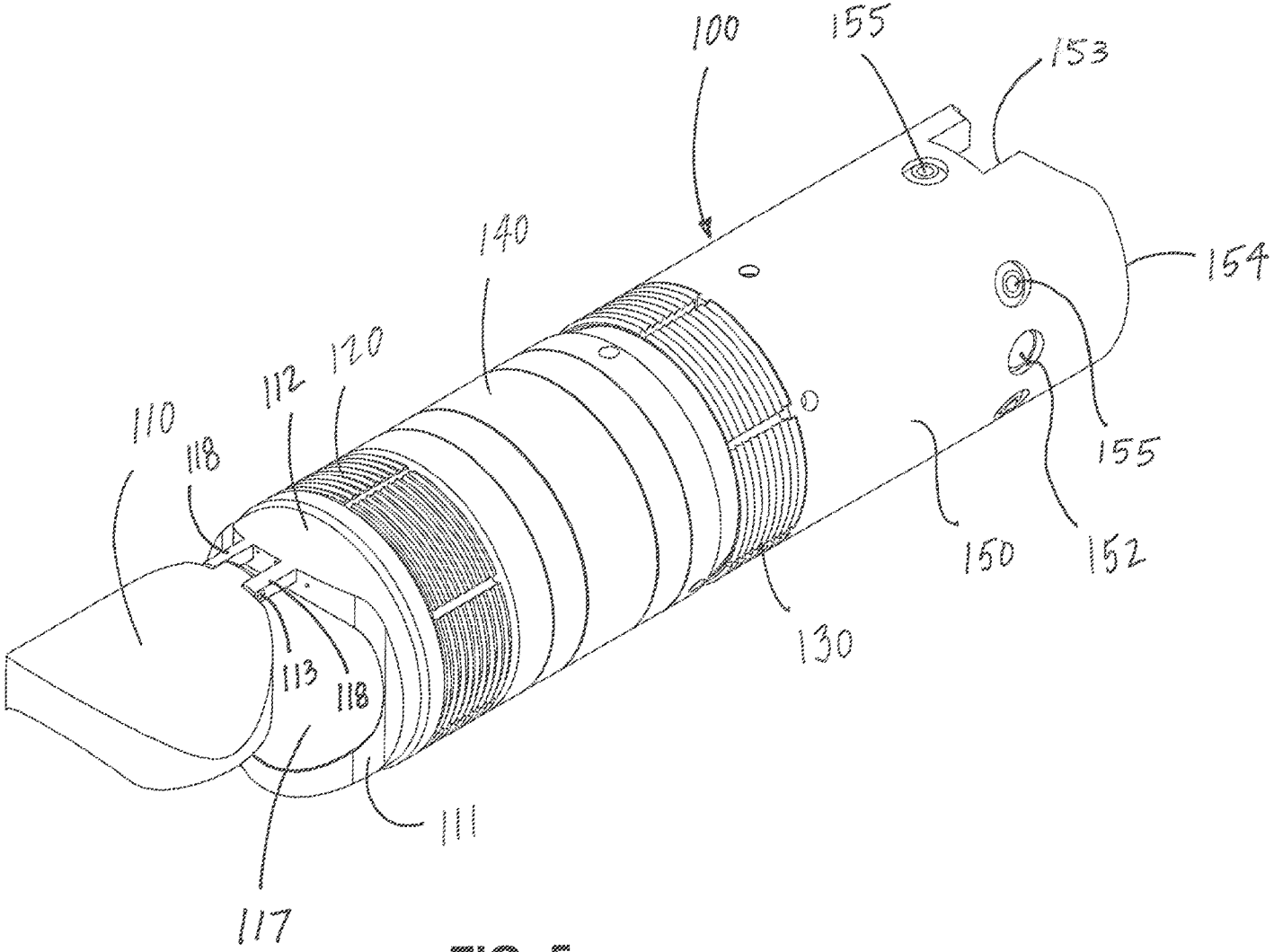
FIG. 5 depicts an overhead perspective view of a downhole valve assembly of the present invention with a flapper valve in an open position.

FIG. 4 depicts a side view of a downhole valve assembly 100 of the present invention with flapper valve 110 in a closed position, while FIG. 5 depicts an overhead perspective view of a downhole valve assembly 100 of the present invention with a flapper valve 110 in an open position. As depicted in both FIGS. 4 and 5, a setting tool (such as setting tool 20 depicted in FIGS. 1 through 3) is not present, as it has previously been actuated and retrieved from a well bore, or at least moved away from said valve assembly 100. Valve assembly 100 of the present invention generally comprises a fluid pressure sealing flapper assembly having flapper 110 and flapper seat 111, upper gripping slip members 120, lower gripping slip members 130, seal member 140 and body section 150. Flapper 110 is hingedly attached to flapper seat body 112 with hinge pin 113 extending through parallel hinge posts 118. Seal member 140 is disposed between upper gripping slip members 120 and lower gripping slip members 130.

As depicted in FIG. 4, flapper 110 is closed in mating relationship against flapper seat 111. In this configuration, flapper 110 essentially obstructs the central flow bore of seat body member 112, thereby forming a fluid pressure seal preventing fluid from flowing past said flapper and into said central flow bore of seat body member 112. Conversely, as depicted in FIG. 5, flapper 110 is open and is not in mating relationship against flapper seat 111. In this configuration, flapper 110 does not obstruct the central flow bore 117 of seat body member 112, thereby permitting fluid to flow past said flapper 110 and into said central flow bore 117 of seat body member 112.

Referring to FIG. 5, in a preferred embodiment, the present invention can also comprise at least one friction reducing element 155 disposed on or along the outer surface of body member 150 to assist in reducing frictional forces when conveying said valve assembly 100 within a wellbore (including, without limitation, any restrictions or "tight spots" therein). Such friction reducing elements 155 can be rolling devices such as ball transfer units or stationary sliding pads beneficially disposed on the exterior of the device.

Still referring to FIG. 5, at least one transverse shear pin 152 can extend through body member 150; said shear pin 152 can be used to temporarily operationally attach valve assembly 100 to a setting tool (such as, for example, setting tool 20 depicted in FIG. 1). Additionally, notch 153 can be cut or otherwise formed in the lower surface 154 of said body member 150. In the event that valve assembly 100 would ever need to be drilled or milled, said valve assembly 100 may be pushed downhole within a wellbore until it is received on another valve assembly or other support surface. In such cases, notch 153 can act as an anti-rotation device by receiving and engaging with upwardly facing parallel hinge posts (such as hinge posts 118 depicted in FIG. 4) of an adjacent (lower) valve assembly to prevent spinning or rotation of said upper valve assembly when torque forces are applied to said upper valve assembly (such as, for example, when said valve assembly is being drilled or milled).

Figure 6:
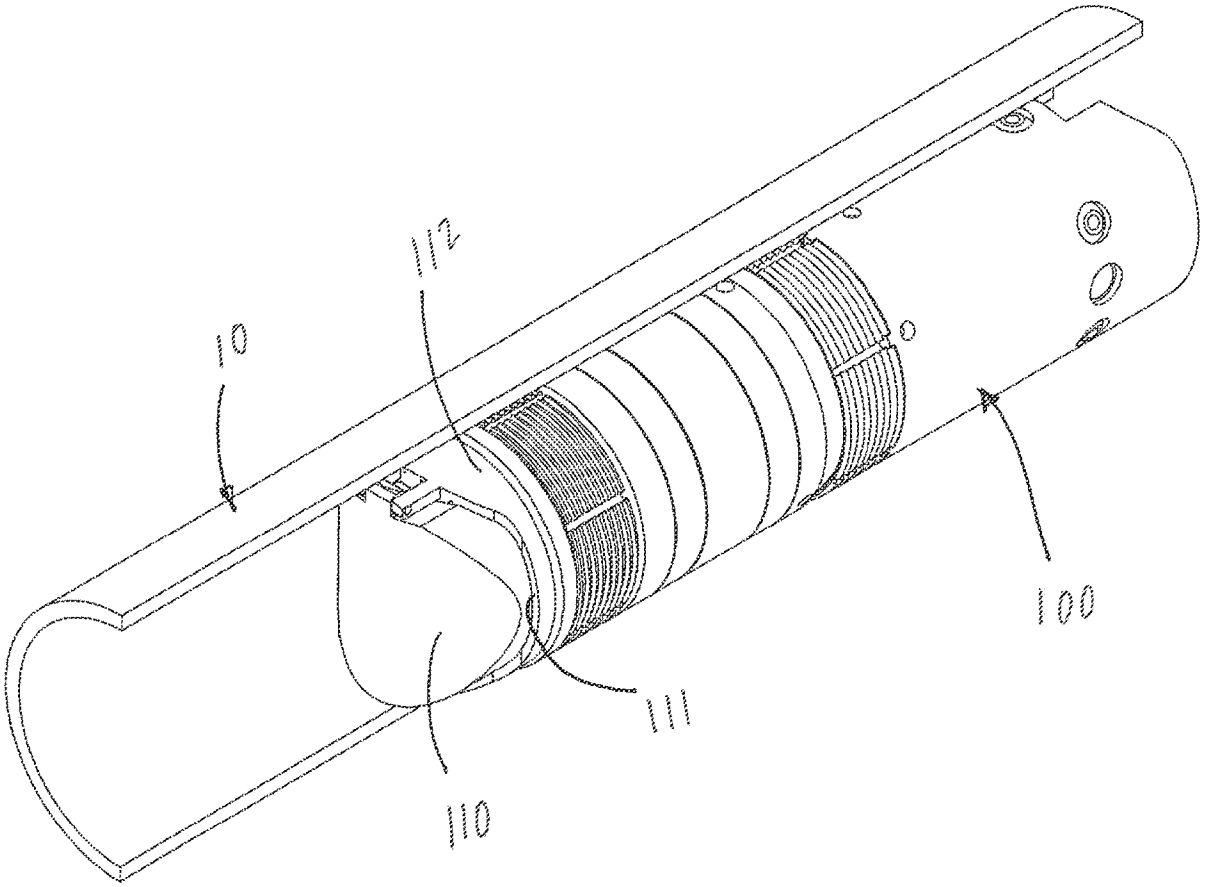
FIG. 6 depicts an overhead perspective view of the downhole valve assembly of the present invention disposed within a wellbore with a flapper valve in a closed position.
Figure 7:
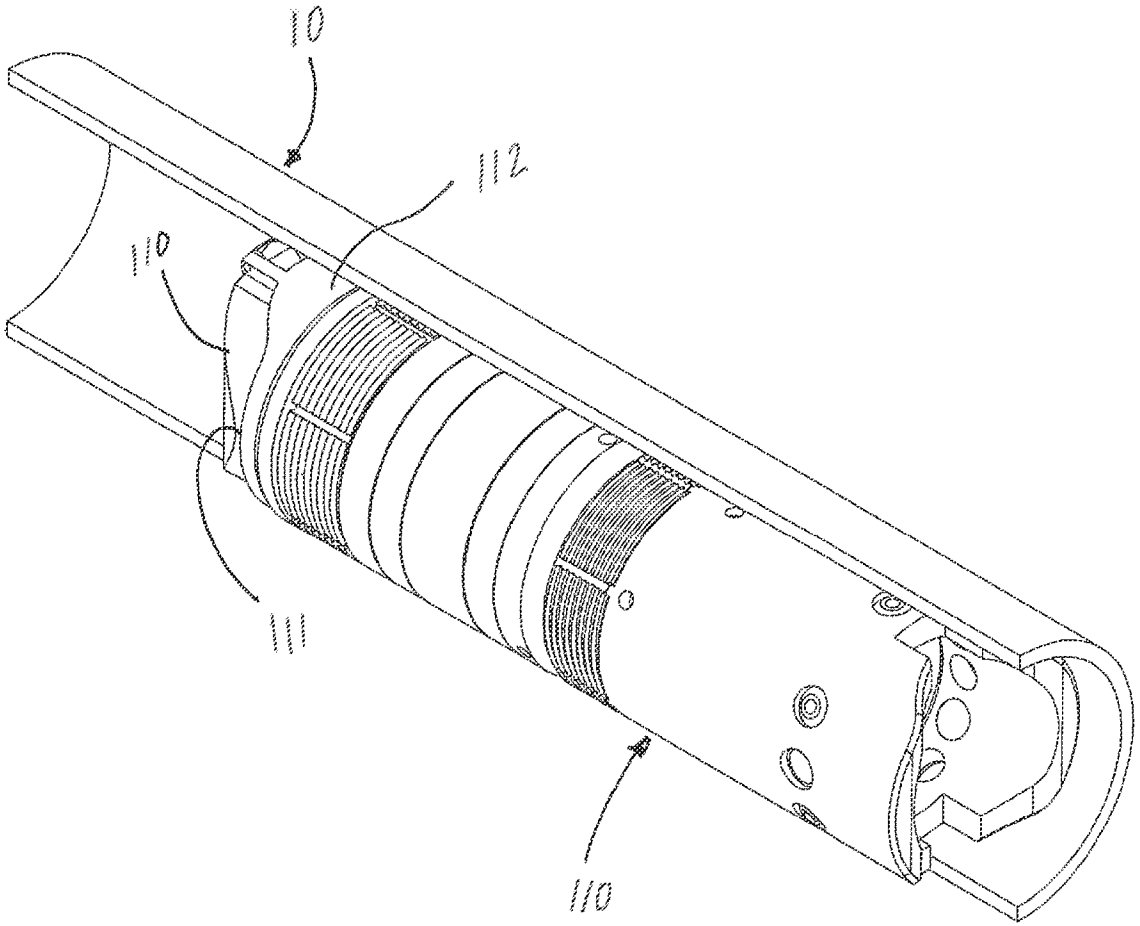
FIG. 7 depicts a bottom perspective view of the downhole valve assembly of the present invention disposed within a wellbore with a flapper valve in a closed position.

FIG. 6 depicts an overhead perspective view of down hole valve assembly 100 of the present invention disposed within the inner bore of casing string 10 with flapper 110 in a closed position. Similarly, FIG. 7 depicts a bottom perspective view of said downhole valve assembly 100 of the present invention disposed within an inner bore of casing string 10 with flapper 110 in a closed position. As depicted in FIGS. 6 and 7, flapper 110 is closed in mating relationship against flapper seat 111. In this configuration, flapper 110 obstructs or blocks the central flow bore of seat body member 112, thereby forming a fluid pressure seal preventing fluid from flowing past said flapper and into said central flow bore of seat body member 112.

Figure 8:
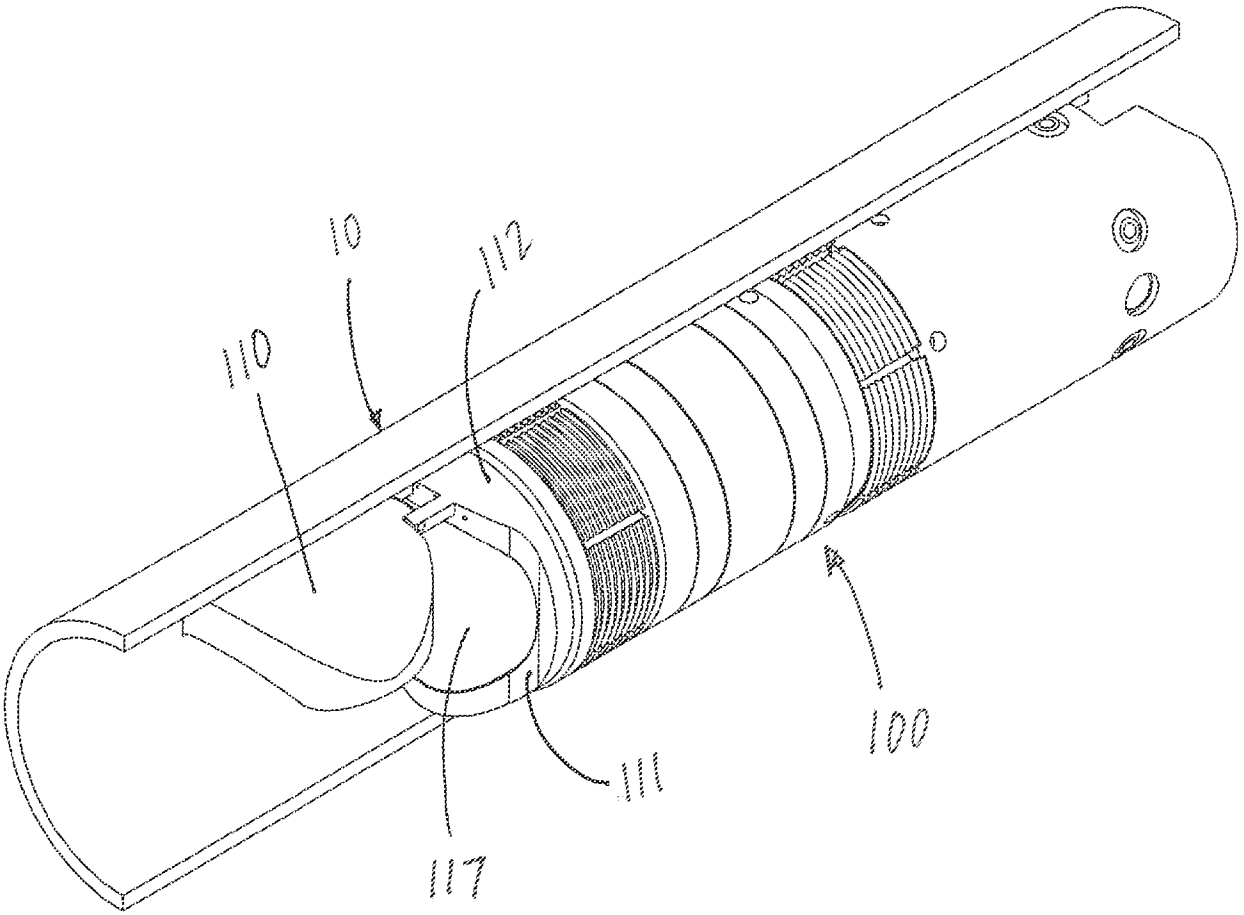
FIG. 8 depicts an overhead perspective view of the downhole valve assembly of the present invention disposed within a wellbore with a flapper valve in an open position.
Figure 9:
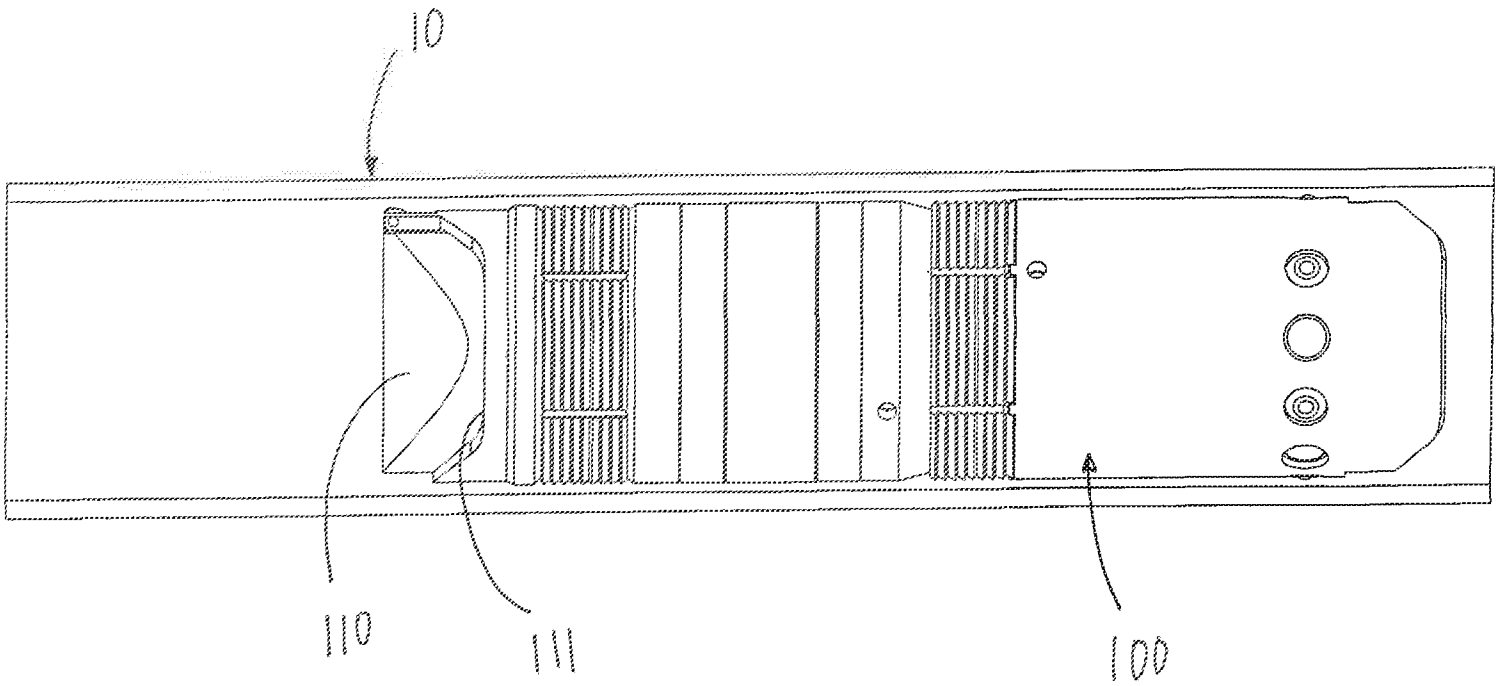
FIG. 9 depicts side view of the downhole valve assembly of the present invention disposed within a wellbore with a flapper valve in a closed position.

FIG. 8 depicts an overhead perspective view of downhole valve assembly 100 of the present invention disposed within an inner through bore of casing string 10 with flapper 110 in an open position, while FIG. 9 depicts side view of downhole valve assembly 100 of the present invention disposed within an inner through bore of casing 10 with flapper 110 in a closed position. As depicted in FIG. 8, flapper 110 is open and is not in mating relationship against flapper seat 111. In this configuration, flapper 110 does not obstruct the central flow bore 117 of seat body member 112, thereby permitting fluid to flow past said flapper 110 and into said central flow bore 117 of seat body member 112.

As depicted in FIG. 8, flapper 110 can embody a scalloped shaped design to allow for increased flow capacity when flapper 110 of valve assembly 100 is in a full open position, while also increasing strength against fluid pressure acting on said flapper 110 due to the curvature of said flapper 110. Still referring to FIG. 8, mating flapper seat 111 can also be scalloped to match the contours and surfaces of flapper 110 to ensure that a tight fluid pressure seal is formed when said flapper 110 is closed in mating relationship against a flapper seat 111. To further facilitate sealing between flapper 110 and a mating flapper seat 111, a sealing material such as an elastomeric or gasket material can be applied to, attached on and/or embedded in said flapper and/or said seat.

Flapper 110 can be constructed of a dissolvable material. If such dissolvable material is used, after a predetermined or preselected length of time, the flapper will dissolve, thereby substantially eliminating any flow obstruction blocking central flow bore 117 of flapper seat body member 112. Although other dissolvable materials having desired characteristics can be used without departing from the scope of the present invention, said flapper 110 can be constructed of magnesium alloy (such as, for example, the compound marketed under the mark "SoluMag"™) having a high but well-controlled corrosion rate, thereby effectively causing flapper 110 to dissolve in a known time.

Alternatively, said flapper 110 may also be constructed of a frangible material that can easily be broken into smaller pieces using a conventional device (such as, for example, an oilfield jar tool) to apply a predetermined contact force to said flapper. After contact with said breaking device, the pieces of flapper 110 are sufficiently small that they can fall to the bottom of the well, or can be circulated back to the surface for removal from a well. Flapper 110 can also be constructed of an easily drillable or millable material; for applications that do not require such removal of said flapper, a stronger, more durable material may be used.

Figure 10:
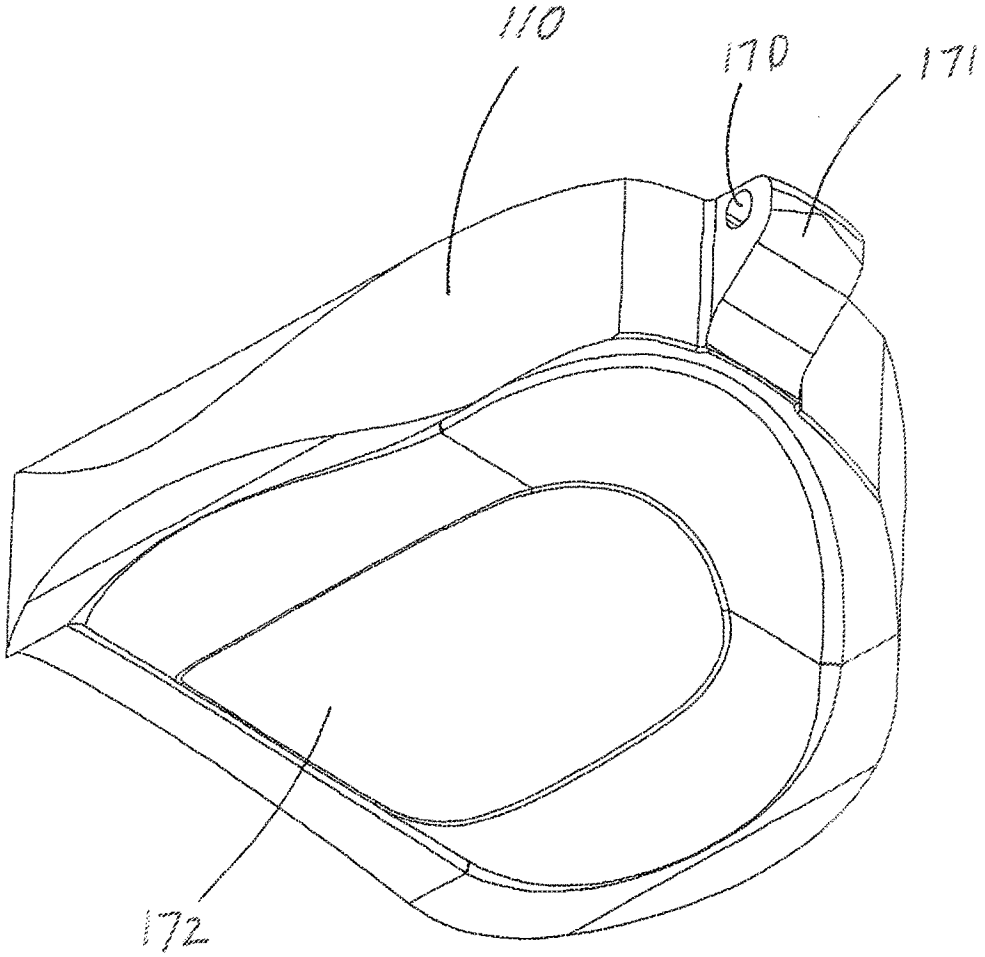
FIG. 10 depicts a perspective view of a flapper of the present invention.

FIG. 10 depicts a perspective view of an alternative embodiment of a flapper 110 of the present invention. Flapper 110 can include hinge body protrusion 170 having transverse aperture 171. Hinge body protrusion 170 can be received between hinge posts 118, while transverse aperture 171 can receive a hinge pin (such as hinge pin 113 depicted in FIG. 3) to permit said flapper 110 to pivotally alternate between an open and closed position as disclosed herein.

In order to withstand greater loading and/or differential pressure across flapper 110, said flapper 110 can optionally include an increased or thicker body section 172 as depicted in FIG. 10. Such body section 172 depicted in FIG. 10 is thicker (i.e., has a greater mass) compared to alternative flappers 110 depicted in FIGS. 11 and 12, for example. When greater volume of dissolvable material is used to construct flapper 110, more time can generally be taken to set valve assembly 100 before said flapper 110 has dissolved to a point that it no longer forms a fluid pressure seal against an opposing seat.

Figure 13:
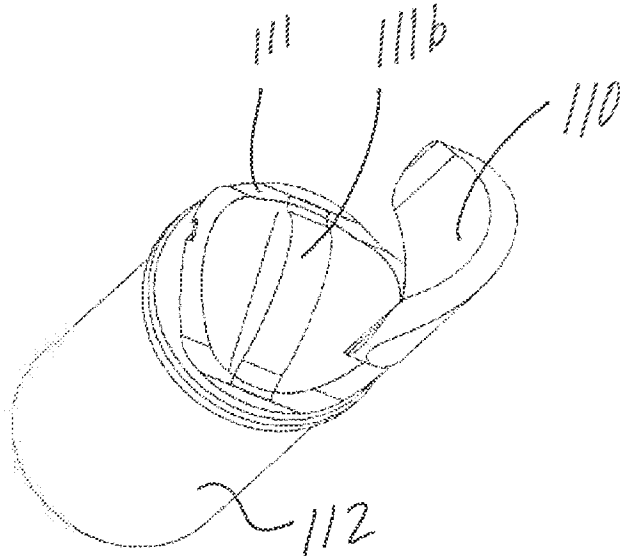
FIG. 13 depicts an overhead perspective view of a third alternative embodiment of a flapper assembly of the present invention.
Figure 12:
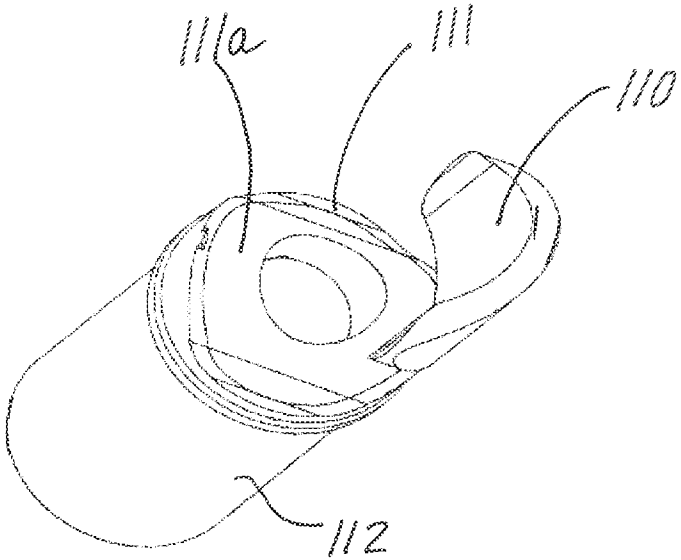
FIG. 12 depicts an overhead perspective view of a second alternative embodiment of a flapper assembly of the present invention.

Further, in order to withstand greater loading and/or differential pressure across flapper 110, seat 111 and tool body 112 can be modified to add support as depicted in FIGS. 12 and 13. As depicted in FIG. 12, seat 111 includes a section 111*a* of increased material around the circumference of bore 117 for receiving flapper 110. As depicted in FIG. 13, seat 111 includes a transverse support 111*b* extending substantially across bore 117 for receiving flapper 110.

The embodiments depicted in FIGS. 12 and 13 reduce unsupported area under flapper 110 by adding a ring of support material around the opening of seat 111 (FIG. 12) or across seat 111 (FIG. 13) thereby allowing the valve assembly to withstand greater fluid pressure applied to the flapper 110. If full bore flow is required, support can be made of dissolvable or frangible material and the aforementioned processes will be employed to remove them after pressure is relieved.

Figure 11:
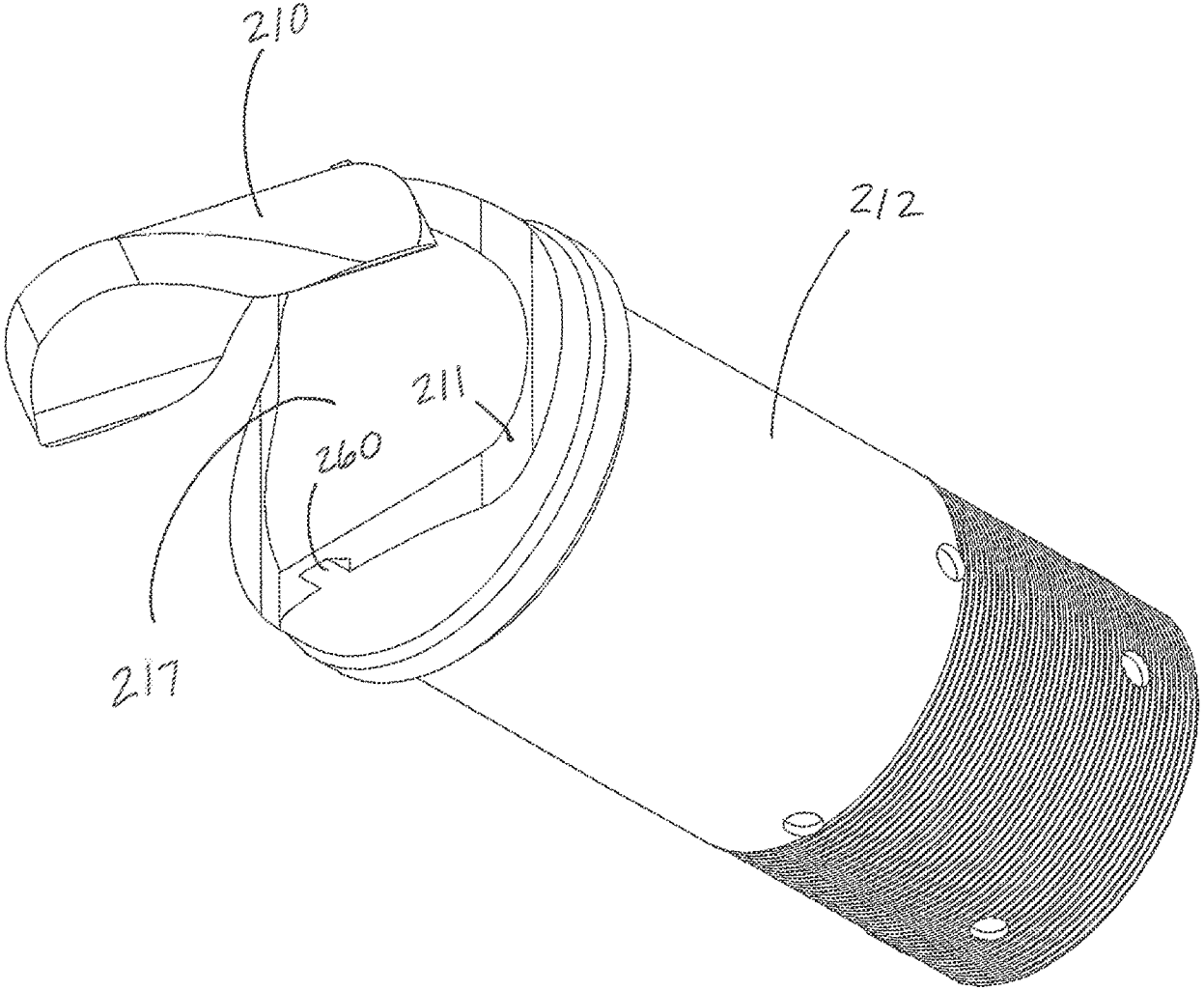
FIG. 11 depicts a perspective view of a first alternative embodiment of a flapper assembly of the present invention.

FIG. 11 depicts a perspective view of an alternate embodiment of a flapper seat body member 212, shown removed from valve assembly 100 of the present invention. As depicted in FIG. 11, flapper seat body member 212 can comprise a central through bore 217. A flapper 210 is hingedly attached to said flapper seat body 212, and a guide pin or protrusion 260 disposed on flapper seat 211. Said guide pin 260 is used to align flapper 210 during actuation and to align the lower sleeve on a setting tool. Guide 260 can be formed as an integral part of flapper seat 211 or can be attached as an additional component.

Figure 14:
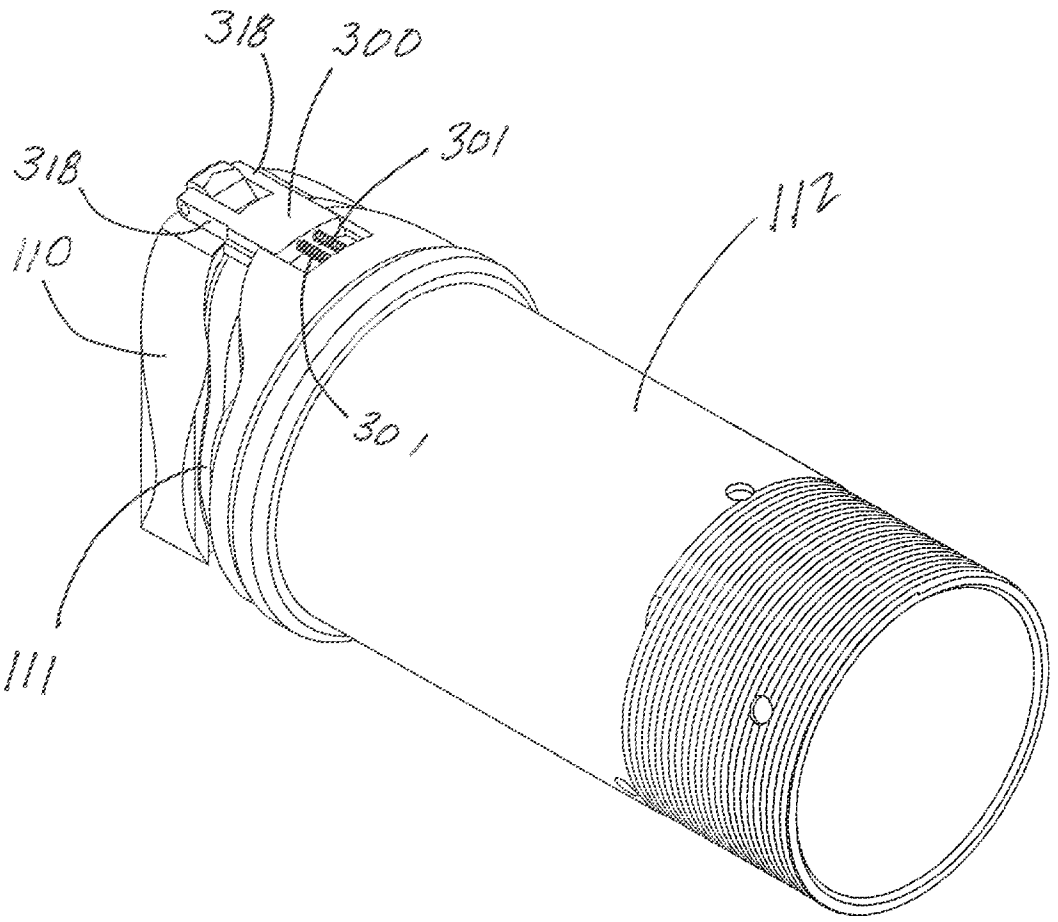
FIG. 14 depicts a lower perspective view of a fourth alternative embodiment of the present invention.

FIG. 14 depicts a perspective view of an alternative embodiment of the flapper mounting assembly present invention. As depicted in FIG. 14, a hinge post assembly 300 having parallel hinge posts 318 can be attached to body member 112. Compression springs 301 can bias said hinge post assembly 300 away from said body member 112. In the embodiment depicted in FIG. 14, said compression springs 301 hold flapper 110 off of seat 111, thereby allowing fluid to flow between the gap formed between said flapper 110 and seat 111, until such time as fluid pressure overcomes the force of compression springs 301, causing said gap to close and create a fluid pressure seal.

During operation, valve assembly 100 of the present invention can be conveyed into a wellbore (via wireline or pipe) to a desired depth. Once at said depth, said valve assembly can be set to grip or anchor to, and form a fluid pressure seal against, the internal surface of a surrounding wellbore. When conveyed on wireline, said valve assembly can be set using a conventional wireline setting tool; when conveyed on pipe, said valve assembly can be set with a conventional hydraulic setting tool. The setting tool can then be at least partially removed from said valve assembly, permitting a flapper (such as flapper 110) to alternate from an open position to a closed position, and contact/close against a seat to form a fluid pressure seal preventing fluid from flowing around said flapper and through a central flow bore of said valve assembly.

Hydraulic fracturing or other operations can be performed within said wellbore. When desired, a frangible flapper can be selectively shattered into many small pieces by the application of contact force, such as via a conventional oilfield jar device. Such smaller shattered pieces can fall to the bottom of the wellbore, or can be circulated out of the wellbore. Alternatively, a dissolvable flapper can be permitted to dissolve within fluid(s) contained in said wellbore, thereby eliminating said fluid pressure seal between said flapper and seat.

What is claimed:

1. A valve assembly comprising:

a) a body section having an upper surface, an outer surface, and a central flow bore having an upper opening defining a seat at said upper surface;

b) a transverse support member extending substantially across said central flow bore at said seat;

c) at least one slip member disposed on said outer surface adapted to selectively grip against an inner surface of a wellbore;

d) at least one elastomeric sealing member disposed on said outer surface adapted to selectively form a fluid pressure seal against said inner surface of said wellbore; and e) a flapper hingedly attached to said body section, wherein said flapper can move between a substantially open configuration, and a substantially closed configuration wherein said flapper contacts said seat and said transverse support member.

2. The valve assembly of claim 1, wherein said valve assembly can be conveyed into said wellbore on wireline and set using a wireline setting tool.

3. The valve assembly of claim 1, wherein said valve assembly can be conveyed into said wellbore on pipe and set using a hydraulic setting tool.

4. The valve assembly of claim 1, wherein said flapper and said transverse support member are constructed of frangible material adapted to selectively break into smaller pieces in response to application of a predetermined force to said flapper and said transverse support member.

5. The valve assembly of claim 4, wherein said smaller pieces can be circulated out of said wellbore when broken.

6. The valve assembly of claim 1, wherein said flapper and said transverse support member are constructed of dissolvable material.

7. The valve assembly of claim 6, wherein said dissolvable flapper and said dissolvable transverse support member are adapted to substantially uncover said central flow bore after dissolving.

8. A method of performing hydraulic fracturing operations in a wellbore comprising:

a) conveying a valve assembly into a wellbore, wherein said valve assembly comprises:

i) a body section having an upper surface, an outer surface and a central flow bore having an upper opening defining a seat at said upper surface;

ii) a transverse support member extending substantially across said central flow bore at said seat;

iii) at least one slip member disposed on said outer surface adapted to selectively grip against an inner surface of said wellbore;

iv) at least one elastomeric sealing member disposed on said outer surface adapted to selectively form a fluid pressure seal against the inner surface of said wellbore;

v) a flapper hingedly attached to said body section, wherein said flapper can move between a substantially open configuration, and a substantially closed configuration wherein said flapper contacts said seat and said transverse support member;

b) setting said valve assembly at a desired position in said wellbore;

c) closing said flapper; and d) conducting hydraulic fracturing operations in said wellbore.

9. The method of claim 8, wherein said valve assembly is conveyed into said wellbore on wireline and set using a wireline setting tool.

10. The method of claim 8, wherein said valve assembly is conveyed into said wellbore on pipe and set using a hydraulic setting tool.

11. The method of claim 8, wherein said flapper and said transverse support member are constructed of frangible material adapted to selectively break into smaller pieces in response to application of a predetermined force to said flapper and said transverse support member.

12. The method of claim 11, wherein said smaller pieces can be circulated out of said wellbore when broken.

13. The method of claim 8, wherein said flapper and said transverse support member are constructed of dissolvable material.

14. The method of claim 13, wherein said dissolvable flapper and transverse support member are dissolved to substantially uncovers said central flow bore following completion of said hydraulic fracturing operations.

15. A valve assembly comprising:

a) a body section having an upper surface, a lower surface, an outer surface, a central flow bore having an upper opening defining a seat at said upper surface, a hinge post disposed at said upper surface, and notch disposed at said lower surface;

b) a transverse support member extending substantially across said central flow bore at said seat;

c) at least one ball transfer unit disposed on said outer surface configured to contact an inner surface of a wellbore;

d) at least one slip member disposed on said outer surface configured to selectively grip against said inner surface of said wellbore;

e) at least one elastomeric sealing member disposed on said outer surface adapted to selectively form a fluid pressure seal against said inner surface of said wellbore; and f) a flapper hingedly attached to said hinge post of said body section, wherein said flapper can move between a substantially open configuration, and a substantially closed configuration wherein said flapper contacts said seat and said transverse support member.

16. The valve assembly of claim 15, wherein said flapper and said transverse support member are constructed of frangible material adapted to selectively break into smaller pieces in response to application of a predetermined force to said flapper and said transverse support member.

17. The valve assembly of claim 16, wherein said smaller pieces can be circulated out of said wellbore when broken.

18. The valve assembly of claim 15, wherein said flapper and said transverse support member are constructed of dissolvable material.

19. The valve assembly of claim 18, wherein said dissolvable flapper and said dissolvable transverse support member are adapted to substantially uncover said central flow bore after dissolving.

20. The valve assembly of claim 15, wherein said hinge post is configured to be selectively received within a notch of an adjacent valve assembly disposed in said wellbore.

* * * * *